United States Patent [19]

O'Hara et al.

[11] 4,304,394

[45] Dec. 8, 1981

[54] LOG LIFTING DEVICE

[76] Inventors: Harold N. O'Hara, 617 Highview Rd., E. Peoria, Ill. 61611; John E. Watson, R.R. #2, Manito, Ill. 61546

[21] Appl. No.: 183,227

[22] Filed: Sep. 2, 1980

[51] Int. Cl.[3] ..... B66F 13/00

[52] U.S. Cl. ..... 254/264; 254/DIG. 1; 254/133 R; 414/23; 414/592

[58] Field of Search ..... 254/47, DIG. 1, 133, 254/264, 389, 390; 414/23, 592

[56] References Cited

U.S. PATENT DOCUMENTS

| | | | |
|---|---|---|---|
| 2,297,556 | 9/1942 | Hermann | 254/DIG. 1 |
| 2,474,045 | 6/1949 | Freeland | 254/390 |
| 2,492,597 | 12/1949 | Schradt | 254/264 |

*Primary Examiner*—Robert C. Watson
*Attorney, Agent, or Firm*—Mason, Kolehmainen, Rathburn & Wyss

[57] ABSTRACT

A log lifting device is described that includes an upstanding post with an attached flexible strand. The flexible strand, such as a chain, releasably connects the post to a jack. Guide members on the post cause the flexible strand to extend generally parallel to the post for a substantial portion of the length of the post. The flexible strand may include a thin, rigid extension at one end to enable the strand to be threaded under a log to be lifted. The end passed under the log to be lifted is then attached to a jack. The log is raised upwardly generally parallel the length of the support member in response to an upward force applied by the jack.

12 Claims, 4 Drawing Figures

LOG LIFTING DEVICE

BACKGROUND OF THE INVENTION

1. Field of the Invention

This invention relates generally to lifting devices and particularly to devices for lifting logs to facilitate their cutting.

2. Brief Description of the Prior Art

In sawing logs it is desirable to lift at least one end of the log to a position above the ground to prevent the cutting means from binding in the logs or contacting the ground. U.S. Pat. No. 2,492,597 to Schnadt describes a log lifting jack composed of two spaced posts, one being a jack, with a chain connected to each post at only one point, hanging in between in a catenary shape.

SUMMARY OF THE INVENTION

It is an object of the present invention to provide an apparatus that facilitates the lifting of the logs for cutting.

It is another object of the present invention to provide a particularly stable log lifting device not prone to tipping over in use.

These and other objects of the present invention are provided by a stable, portable log lifting device for use in conjunction with a jack to raise logs for cutting. The device includes an upstanding support member and a flexible connecting means for supporting the logs to be cut. The flexible connecting means is connectable between the support member and a jack and forms a support surface for the logs to be lifted. Also included are means for guiding the flexible connecting means so that it will extend generally parallel to the upstanding support member for a portion of its length. This results in the conversion of the substantial portion of the weight of the log held on the connecting means into a force along the length of the support member.

BRIEF DESCRIPTION OF THE DRAWINGS

These and other objects of the present invention will become more apparent by reference to the following description taken in conjunction with the accompanying drawing, wherein.

DESCRIPTION OF THE PREFERRED EMBODIMENT

Figure 1:
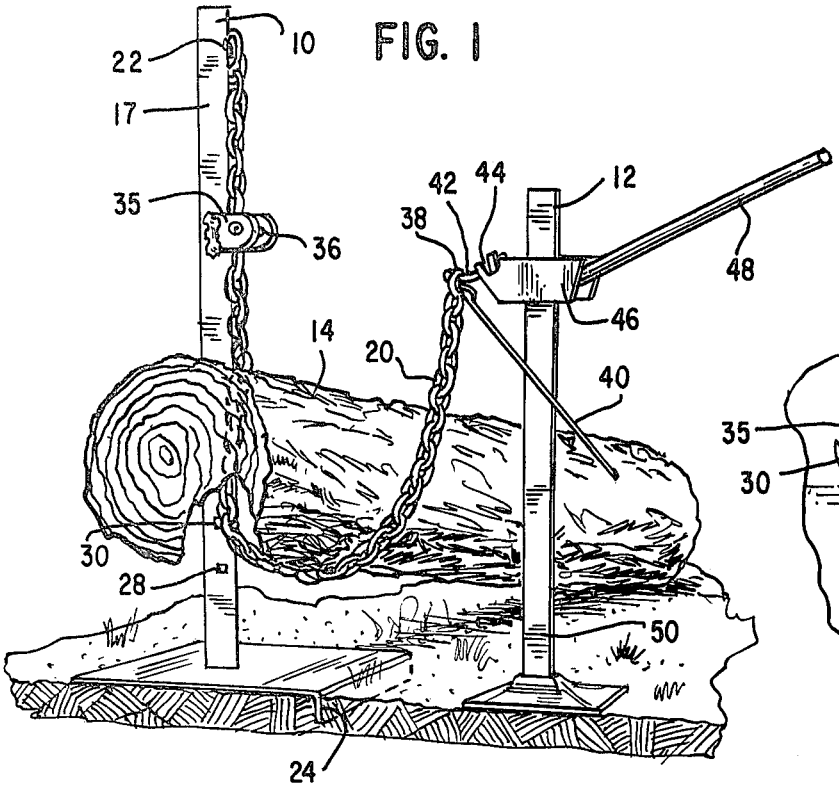
FIG. 1 is a perspective view of one embodiment of the present invention in use.

Referring to the drawing wherein like reference characters are used for like parts throughout, there is shown in FIG. 1 a log lifting device 10 connected to a jack 12. The log lifting device 10 and the jack 12 extend parallel to one another and are spaced a short distance apart, conveniently, approximately two diameters of the log to be cut. The log 14, shown in its lifted position in FIG. 1, is located generally transversely to the common plane including log lifting device 10 and jack 12.

Figure 3:
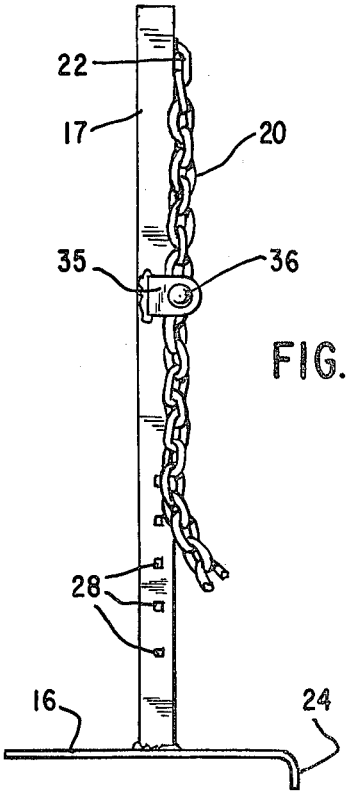
FIG. 3 is a partially cut-away side-elevational view of the embodiment shown in FIG. 1.

As shown in FIG. 3 the log lifting device 10 includes a L-shaped base plate 16, a vertically upstanding post 17 connected centrally atop the L-shaped base plate 16, and a chain 20 attached to the upstanding post 17 by means of welded connection 22 on one end and releasably attached to jack 12 on the other end. The downwardly directed flange 24 of L-shaped base plate 16 serves to grip the ground beneath the log lifting device 10 to prevent slipping or sliding of the device in use. The vertically upstanding post 17, illustrated as a V-shaped angle iron bar, can have any conventional shape.

Figure 4:
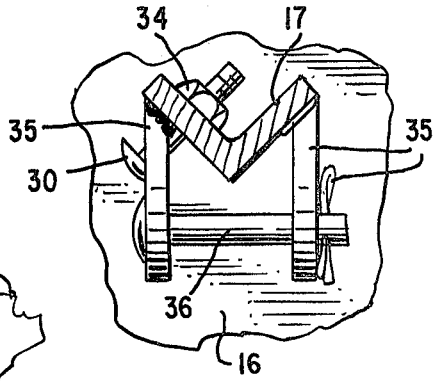
FIG. 4 is a cross-sectional view taken generally along the lines 4—4 in FIG. 2.
Figure 2:
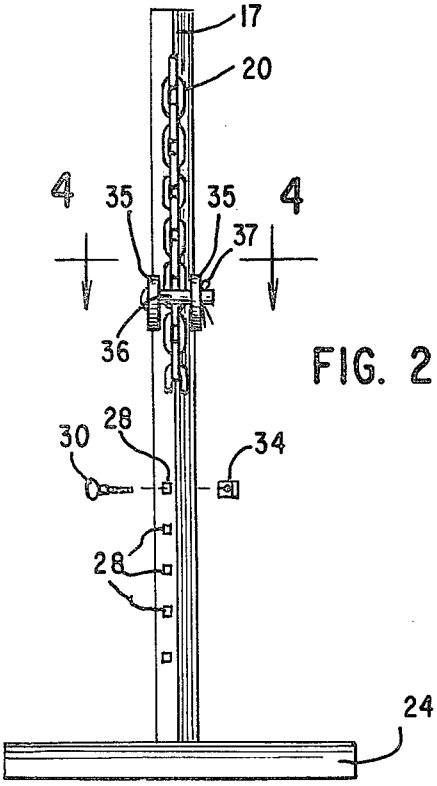
FIG. 2 is a partially cut-away, partially exploded front elevational view of the embodiment shown in FIG. 1.

As best shown in FIG. 2, a plurality of spaced serially aligned holes 28 extend along the length of the post 17 near its lower end. The holes 28 are designed to receive a pin 30 which connects the chain 20 loosely to the post 17 near its lowermost end. As shown in FIG. 4, the pin 30, conveniently a carriage bolt, passes freely through a hole 28 retained by an enlarged head 32 on one end and a nut 34 on the other side of the post 17. Preferably the holes 28 are much larger than the diameter of the pin 30 to freely journal the pin 30 therein allowing movement of the chain 20 along the length of the post 17.

Approximately midway between the connection 22 and the point of securement of pin 30, a guide bar 36 shown in FIGS. 2 and 4 is secured to vertically upstanding post 17 through a pair of spaced, outwardly directed flanges 35, fixed by a cotter pin 37. The guide bar 36 extends transversely to the direction of extension of the chain 20 and serves to guide the chain 20 generally along the length of the post 17, by preventing free movement of the chain 20 away from post 17. Thus, the guide bar 36 is a non-weight bearing member. Similarly, the pin 30 guides chain 20 freely along post 17 permitting vertical movement of the chain 20 while carrying little or none of the load to be lifted.

The chain 20 is of sufficient length to extend well away from the pin 30 for releasable connection to a jack 12 while providing sufficient length therebetween to support a log 14. The jack end 38 of the chain 20 is connected to a rigid, elongate rod 40. The elongate rod 40 facilitates the threading of the chain 20 beneath the log 14 when the log is resting on the ground before connection to the log lifting device 10. Thus, the user merely forces the rod 40 beneath the log 14, if necessary by running the rod 40 slightly into the dirt, grabbing the rod on the other side of the log, and pulling it through. The jack end 38 of the chain 20 is then releasably attached to the jack 12 by a ring 42 that fits into a slot 44 on the travelling member 46 of the jack 12.

The device operates as follows. The user first positions the log lifting device 10 and the jack 12 on opposite sides of a log 14 to be lifted. The user then determines the desired log elevation, positions the pin 30 in an appropriate hole 28, and secures the pin by fastening the nut 34 to the pin where it extends from the opposite side of the post 17. Using the elongate rod 40 the chain 20 is then threaded beneath the log 14 and attached by means of ring 42 to slot 44 on travelling member 46. The rod 40 then hangs freely from the jack end 38 of chain 20. With the jack 12 and log lifting device 10 arranged face to face, the log 14 is lifted by reciprocating the jack handle 48 causing the travelling member 46 to move upwardly on beam 50 of jack 12. This results in the application of an upward lifting force to the log 14 through the chain 20. The user continues to manipulate the handle 48 until the log is lifted to the desired height.

During the lifting of the log 14 the weight of the log is borne unequally by the jack 12 and the upstanding post 17 of log lifting device 10. More particularly, the portion of the load carried by post 17 is transferred directly from the chain to the welded connection 22 and little or no weight is borne by the pin 30 or guide bar 36. Pin 30 and guide bar 36 function to guide the chain 20 so that it extends generally parallel to the length of the vertically upstanding post 17. Thus, the log 14 tends to move upwardly in a direction parallel to the length of post 17 and closely adjacent thereto. As a result, more of the weight of the log is carried by the device 10 than is carried by the jack 12. This is desirable since the guide bar 36 and pin 30 transform the weight of the log into a force predominately directed parallel to the length of the upstanding post 17 resulting in a smaller component of force transverse to the length of the post 17 that tends to tip the device 10 over. Moreover, if the device 10 starts to tip towards the jack 12 a counteracting force component will automatically be generated at connection 22 since the load always exerts its force generally along the length of the post 17. Therefore there will be a component of force tending to right the post 17 as soon as it starts to tip toward the log. This makes the device particularly stable, minimizing the risk of tipping. Thus, particularly when the ground is unstable logs can be lifted for cutting more safely than in the past.

The foregoing detailed description has been given for clearness of understanding only and no unnecessary limitations should be understood therefrom. Many modifications and variations will be obvious to those skilled in the art. Thus, it is to be understood that, within the scope of the appended claims, the invention may be practiced otherwise than as specifically described above.

What is claimed is:

1. A stable, portable log lifting device for use in conjunction with a jack to raise logs for cutting, comprising:

an upstanding support member;

a flexible connecting means for supporting said logs, connectable between said support member and said jack and forming a support surface for said logs to be lifted;

means for guiding said flexible connecting means to extend generally parallel to said member for a portion of its length to convert a substantial portion of the weight of a log supported on said connecting means into a force along the length of said member; and a rigid elongate member attached to the end of said flexible connecting means to be connected to said jack for facilitating the passage of the flexible connecting means under the log to be lifted.

2. The device of claim 1 wherein said flexible connecting means is a chain.

3. The log lifting device of claim 1 wherein said means for guiding said flexible connecting means includes a pair of substantially non-load bearing guide members spaced along the length of said support member.

4. The device of claim 3 wherein the lower of said pair of guide members is selectively adjustable to different relative elevations.

5. The device of claim 4 wherein the lowermost guide member is a pin, said upstanding post having a plurality of slots spaced along its length, said pin selectively engageable in a plurality of said slots.

6. The device of claim 5 wherein said pin is a carriage bolt.

7. The device of claim 3 wherein at least one of said guide members is a collar encircling said chain to allow the chain to move freely along said upstanding member relative to said collar.

8. The device of claim 1 including a support surface for said upstanding member, said support surface having a downwardly extending ground engaging flange.

9. The device of claim 1 wherein said flexible connecting means is fixed to said support member at a point substantially above the desired height of lifting of said log.

10. A stable, portable log lifting device for use in conjunction with a jack to raise logs for cutting, comprising:

an upstanding support member;

a flexible connecting means for supporting said logs, connectable between said support member and said jack and forming a support surface for said logs to be lifted; and means for guiding said flexible connecting means to extend generally parallel to said member for a portion of its length to convert a substantial portion of the weight of a log supported on said connecting means into a force along the length of said member, said means for guiding said flexible connecting means including a pair of substantially non-load bearing guide members spaced along the length of said support member, the lower of said pair of guide members being selectively adjustable to different relative elevations.

11. The device of claim 10 wherein the lowermost guide member is a pin, said upstanding post having a plurality of slots spaced along its length, said pin selectively engageable in a plurality of said slots.

12. The device of claim 11 wherein said pin is a carriage bolt.

* * * * *